US009038867B2

(12) United States Patent
Elksnitis et al.

(10) Patent No.: US 9,038,867 B2
(45) Date of Patent: May 26, 2015

(54) DEGASSER SNORKEL WITH SERPENTINE FLOW PATH COOLING

(75) Inventors: Andrew Elksnitis, Homestead, PA (US); Michael J. Sherman, Portage, IN (US)

(73) Assignees: TYK America, Inc., Clarion, PA (US); Arcelormittal S.A., Luxembourg (LU)

( * ) Notice: Subject to any disclaimer, the term of this patent is extended or adjusted under 35 U.S.C. 154(b) by 229 days.

(21) Appl. No.: 13/466,462

(22) Filed: May 8, 2012

(65) Prior Publication Data

US 2012/0286000 A1 Nov. 15, 2012

Related U.S. Application Data

(60) Provisional application No. 61/484,871, filed on May 11, 2011.

(51) Int. Cl.

| | |
|---|---|
| ***B22D 39/00*** | (2006.01) |
| ***B22D 41/005*** | (2006.01) |
| ***C21C 7/10*** | (2006.01) |

(52) U.S. Cl.

CPC ..... *C21C 7/10* (2013.01)

(58) Field of Classification Search

CPC ..... C21C 7/10; C21C 7/04; C21C 7/072; B22D 2/003; B22D 11/11

USPC ..... 222/603, 592, 595; 266/208, 209, 210, 266/286; 75/508, 509, 708, 511, 510

See application file for complete search history.

(56) References Cited

U.S. PATENT DOCUMENTS

| | | | | | |
|---|---|---|---|---|---|
| 3,422,857 | A | * | 1/1969 | Napora | 138/143 |
| 3,572,541 | A | | 3/1971 | Shapland | |
| 4,241,904 | A | * | 12/1980 | Nagashima et al. | 266/209 |
| 5,520,373 | A | * | 5/1996 | Keilman et al. | 266/209 |
| 5,520,718 | A | | 5/1996 | Keilman et al. | |
| 5,911,946 | A | | 6/1999 | Aichinger et al. | |
| 6,537,485 | B2 | | 3/2003 | Demukai | |
| 6,638,471 | B1 | | 10/2003 | Wagener et al. | |
| 8,268,233 | B2 | * | 9/2012 | MacRae | 266/270 |

FOREIGN PATENT DOCUMENTS

| | | | | |
|---|---|---|---|---|
| JP | 57012803 | * | 1/1982 | B01D 19/00 |
| JP | 58096813 | | 6/1983 | |
| JP | 61253318 | | 11/1986 | |
| JP | 1272715 | | 10/1989 | |
| JP | 3170612 | | 7/1991 | |
| JP | 5171251 | | 7/1993 | |
| WO | 2004466391 | | 6/2004 | |
| WO | 2007021207 | | 2/2007 | |

* cited by examiner

*Primary Examiner* — Scott Kastler
*Assistant Examiner* — Michael Aboagye
(74) *Attorney, Agent, or Firm* — Cohen & Grigsby, P.C.

(57) ABSTRACT

A snorkel nozzle (10) having a double shell core (16, 26) that defines an annular gap (40) between the shells and that has an array of baffles (66) arranged in the annular gap to define a serpentine flow path for cooling gases that pass through the annular gap.

15 Claims, 3 Drawing Sheets

DEGASSER SNORKEL WITH SERPENTINE FLOW PATH COOLING

BACKGROUND OF THE INVENTION

1. Field of the Invention

The presently disclosed invention relates to an apparatus for making low carbon steel and, in particular, improved snorkels for conveying molten metal between the ladle and a vacuum vessel.

2. Discussion of the Prior Art

For many years it has been known that workability of steel can be significantly improved by decreasing the carbon content of the steel. More recently, there has been a growing demand for low carbon steel. In some applications such as thin gauge steel that is used in automotive applications, it is preferred to use ultra low carbon steel in which the carbon content is reduced to about 0.005%.

In the process for making ultra low carbon steel known as the RH process, the carbon content of the steel is reduced by lowering the partial pressure of carbon monoxide at the surface of the molten metal. More specifically, the molten metal is drawn from the steel ladle into a vacuum vessel that is located above the ladle. It is known in the art to locate two snorkels at ports in the bottom of the vacuum vessel and that extend downwardly toward the steel ladle. The snorkels are sufficiently long that when the vacuum vessel and the steel ladle are brought vertically closer together, the free ends of the snorkels extend into the steel ladle to an elevation below the normal surface of the molten metal.

One of the snorkels designated as the "up leg snorkel" incorporates passageways for an inert gas such as argon. At times when the free end of the up leg snorkel is below the surface of the molten metal in the ladle and a partial vacuum is established in the vacuum vessel, inert gas is injected into the molten steel inside the up leg snorkel to support the upward movement of the molten steel through the up leg snorkel and into the vacuum vessel. This also creates turbulence in the molten metal to increase the efficiency of the process by increasing the rate of carbon removal. Molten metal in the vacuum vessel then re-enters the steel ladle through the "down leg" snorkel.

Processing time for circulation of the molten metal through the vacuum vessel is typically about thirty minutes. During that time, the snorkels are exposed to the molten metal so that the temperature of the snorkels significantly increases. Molten metal is located both inside and outside the snorkels so that heat from the molten metal penetrates the snorkels both from the inner bore and from the outer surface.

Typically, the snorkels are constructed of a steel shell with the surface of the inner bore and the outer surface of the snorkel protected by refractory materials. The coefficient of thermal expansion of the steel shell is greater than the coefficient of thermal expansion of the refractory materials. Therefore, prolonged heating of the snorkel have resulted in cracks in the outer layer of refractory concrete. The refractory cracks allow subsequent penetration of the molten steel. Unless the snorkel is taken out of service and the refractory concrete repaired or replaced, the cracks will ultimately lead to catastrophic failure of the snorkel.

Similarly, the inner refractory material is a brick layer. The brick layer is steadily eroded by the turbulent action of the molten metal caused by the injection of the inert gas. As the brick layer grows thinner, the rate of heat transference from the molten metal to the steel shell increases. Again, unless the snorkel is taken out of service and the brick layer repaired or replaced, the brick layer will present an insufficient thermal barrier and lead to catastrophic failure of the snorkel. Accordingly, it was recognized in the prior art that systems or methods for retarding the rate of heating of the steel shell in the snorkels would advantageously increase the number of heats in which a snorkel could be used without taking it out of service for repairs.

In some prior art snorkels, an array of pipes has been secured to the surface of the steel shell. The pipes are used to convey a cooling medium such as air to and around the steel cylinder to retard temperature increases of the steel cylinder during times that the snorkel is exposed to the molten metal. This arrangement has had some success, but its capability is limited in certain important respects. One significant limitation has been that the cooling capacity is proportional to the volume of cooling medium that is exposed to the steel cylinder. In the prior art, the volume of cooling medium is limited by the size of the pipes in the piping array. The size of the pipes used for conveying cooling medium, and thus the cooling capacity, is limited by the physical geometries of the snorkel.

Accordingly, there was a need in the prior art for an apparatus that could more effectively cool the steel cylinder of the snorkel without otherwise compromising the performance of the apparatus and method for making ultra low carbon steel.

SUMMARY OF THE INVENTION

In the presently disclosed invention, a snorkel for use with a reaction vessel for degassing molten metal includes a first shell with a longitudinal section that may be in the general shape of a cylinder. The snorkel further includes a second shell with a longitudinal section that also may be in the general shape of a cylinder, the second shell being located radially outside of the first shell so that the first and second shells define an annular gap between the outer surface of the first shell and the inner surface of the second shell. A refractory lining is secured to the outer surface of the second shell. Another refractory lining is secured to the inner surface of the first shell such that the opposite, free surface of the refractory lining defines a passageway through the interior of the snorkel. An array of baffles is located in the annular gap between the outer surface of the first shell and the inner surface of the second shell. The baffles may be oriented generally orthogonally to the longitudinal direction of the first and second shells, each of said baffles extending in an angular direction through an arc portion of said annular gap. Longitudinally adjacent baffles alternate two angular positions of the annular gap. The baffles cooperate with longitudinally extending members to create openings between the passageways that are formed between longitudinally adjacent baffles. The openings between the passageways are at one end of the passageway such that the openings and passageways combine to define a serpentine passageway through the annular gap. The serpentine passageway is in fluid communication with an input port and an output port such that there is a pathway for cooling medium flowing into the input port to pass through the serpentine passageway and out of the output port.

Preferably, the array of baffles includes a plurality of arcuate baffles. In addition, the snorkel includes at least two primary members that also are located between the first and second cylinders. The primary members are generally oriented in the direction of the longitudinal axis of the annular gap and at different angular positions of the annular gap. The primary members cooperate with the outer surface of the first shell and the inner surface of the second shell to define at least one passageway from one longitudinal end of the annular gap to the opposite longitudinal end of the annular gap so that the passageway is generally aligned parallel to the longitudinal direction of the annular gap. Each of the arcuate baffles is generally oriented orthogonally to the longitudinal axis of the annular gap between the first and second shells and between first and second angular positions about the longitudinal axis of the annular gap. One end of each of the arcuate baffles is connected to one of the primary members and the other end of the arcuate baffles is a free end that is spaced apart from a primary member to define a flow path between a primary member and the free end of the arcuate baffle.

Other objects and advantages of the presently disclosed invention will become apparent to those skilled in the art as the description of a presently disclosed embodiment of the invention proceeds.

BRIEF DESCRIPTION OF THE DRAWINGS

A presently preferred embodiment of the disclosed invention is further described herein in connection with the accompanying drawings in which.

DESCRIPTION OF A PRESENTLY PREFERRED EMBODIMENT OF THE DISCLOSED INVENTION

Figure 1:
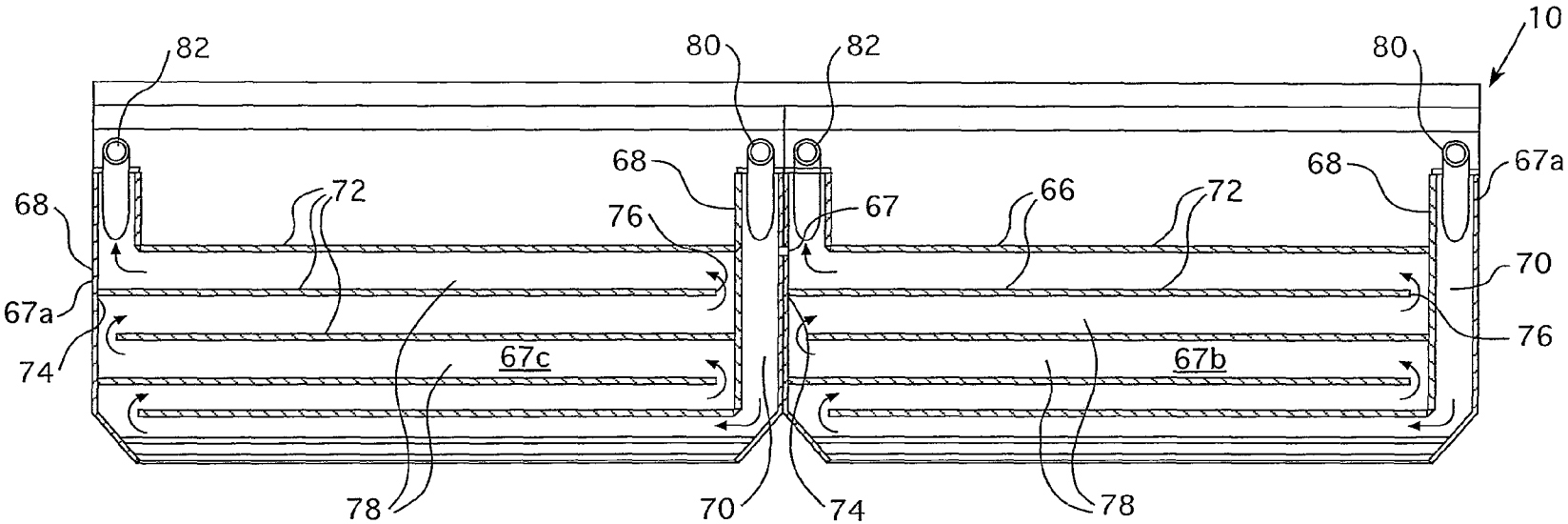
FIG. 1 is an elevation view of the snorkel in accordance the disclosed invention in which the baffle array of the snorkel is vertically bisected and opened along one side of the outer shell show two parallel circuits of a serpentine flow path for conveying cooling medium through the annular gap defined between the first and second shells of the snorkel.
Figure 2:
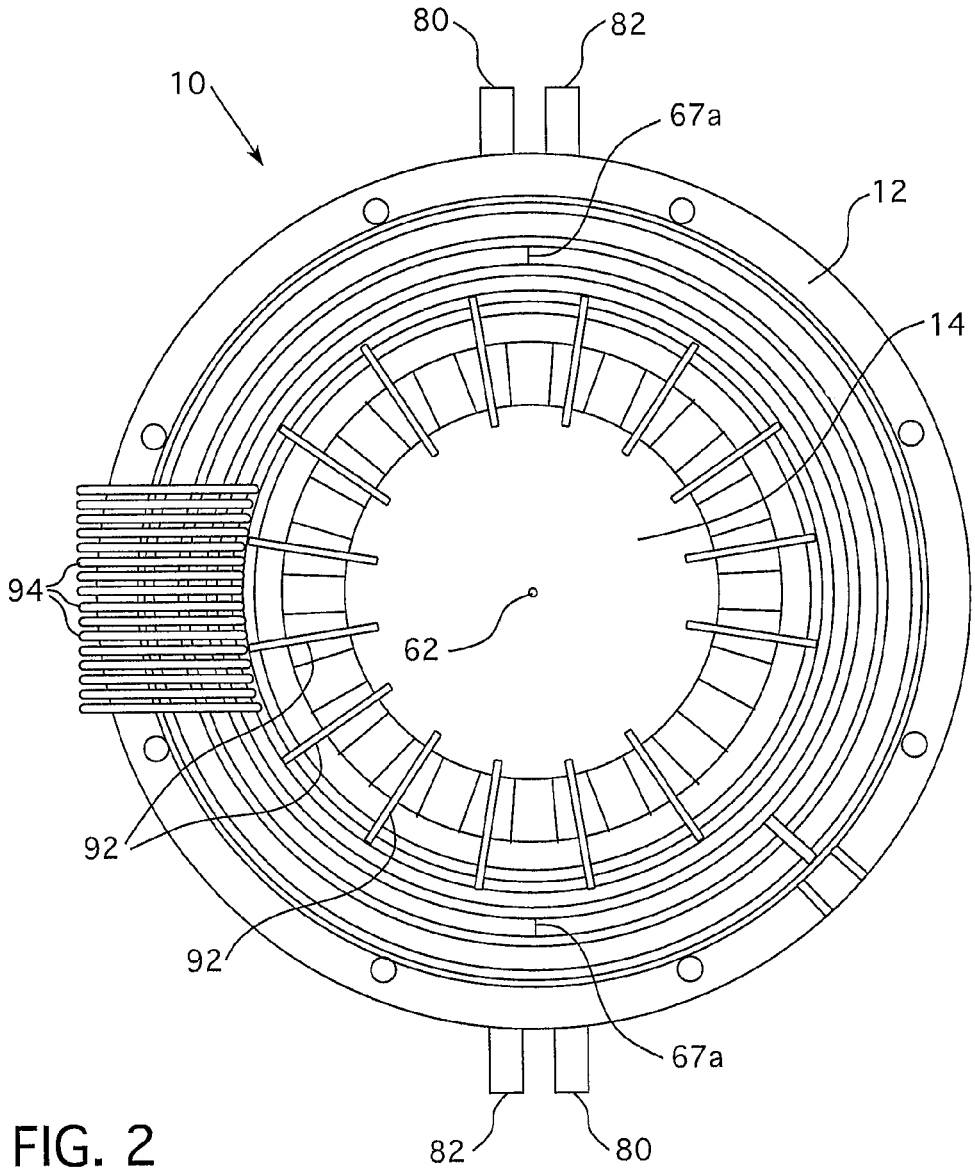
FIG. 2 is a plan view of the snorkel shown in FIG. 1, but with the snorkel in its normal, non-bisected position.
Figure 3:
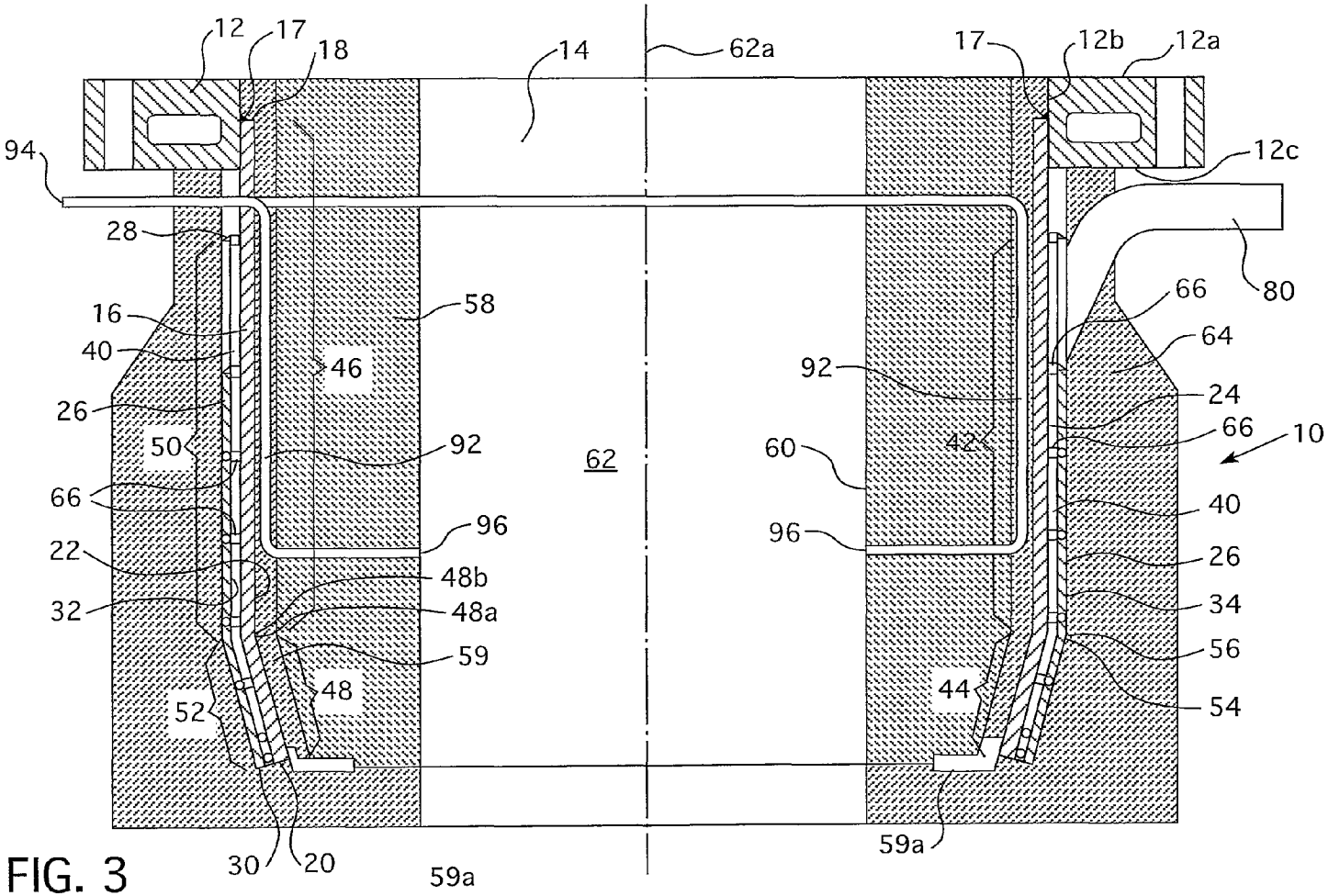
FIG. 3 is an elevation cross-section of the snorkel shown in FIGS. 1 and 2

As shown in FIGS. 1-3, a snorkel generally indicated as 10 is arranged for use with a reaction vessel (not shown) in a metal degassing process. The snorkel provides two parallel air flow circuits, each circuit having a serpentine flow path for cooling medium. The serpentine flow path allows improved cooling of the snorkel at times when it is exposed to molten metal. Snorkel 10 includes a flange 12 that is used to connect the snorkel to the reaction vessel. Flange 12 has a top surface 12*a*, an inner surface 12*b*, and a lower surface 12*c*. The interior of snorkel 10 defines a passageway 14 that is in communication with the interior of the reaction vessel.

Snorkel 10 further includes a first shell 16 that is secured to flange 12 by fillet weld 17. First shell 16 defines a circular upper edge 18 and a circular lower edge 20 such that the first shell further defines a closed inner surface 22 between upper edge 18 and lower edge 20. First shell 16 also defines a closed outer surface 24 between upper edge 18 and lower edge 20.

Snorkel 10 also includes a second shell 26 that defines a circular upper edge 28 and a circular lower edge 30 such that the second shell further defines a closed inner surface 32 and a closed outer surface 34 between the circular upper and lower edges 28 and 30.

Second shell 26 is located concentrically with respect to the first shell 16 with the outer surface 24 of first shell 16 opposing the inner surface 32 of second shell 26 to define an annular gap 40 between surfaces 24 and 32.

In the example of the preferred embodiment, first shell 16 has a first section 46 that is in the general shape of a cylinder and a second section 48 that is in the general shape of a truncated cone with the largest diameter, or base, 48*a* of the truncated cone being joined with a longitudinal end 48*b* of first section 46. Similarly, in the preferred embodiment second shell 26 has a first section 50 that is in the general shape of a cylinder and a second section 52 that is in the general shape of a truncated cone with the largest diameter, or base, 54 of the truncated cone being joined with a longitudinal end 56 of first section 50. First section 50 of second shell 26 is oriented concentrically outside of first section 46 of the first shell 16 and second section 52 of second shell 26 is oriented concentrically outside the second section 48 of the first shell 16. Correspondingly, annular gap 40 includes upper region 42 between first section 46 of the first shell and first section 50 of the second shell. Annular gap 40 also includes a lower region 44 between the second section 48 of said first shell and the second section 52 of the second shell.

Alternatively some snorkels do not include a truncated cone section with the full shell being a right circular cylinder. The truncated cone shape at the lower, or distal, end of the first and second shells 16, 26 is sometimes used to compensate for thermal expansion of the lower distal, ends of the first shell 16 and the second shell 26 (which are remote from flange 12) at times when snorkel 10 is immersed in molten metal. It is thought that this shape sometimes compensates for a "trumpeting" effect of the distal ends of first shell 16 and second shell 26 caused by thermal expansion of the shells while the snorkel is immersed in molten metal.

However, an alternative embodiment of the presently disclosed invention can include first shell 16 and second shell 26 in which the shells are only generally cylindrical as in section 46 of first shell 16 and section 50 of second shell 26. In that embodiment, the first and second shells have sections in the shape of a right circular cylinder. This alternative embodiment is possible in accordance with the presently disclosed invention because the serpentine air flow pathway that is subsequently described herein is effective to control thermal expansion of the distal portion of first shell 16 and second shell 26 so as to avoid "trumpeting."

Referring again to the embodiment of FIGS. 1-3, refractory lining 58 is secured to the inner surface 22 of the first shell 16 by a layer of refractory concrete 59. Refractory lining 58 extends longitudinally from a position that is substantially the same as the longitudinal position of top surface 12*a* of flange 12 to a position that is substantially the same longitudinal position as retainer 59*a* that is secured to first shell 16 adjacent lower edge 20. Refractory lining 58 has an inner surface 60 that defines a longitudinal passageway 62 through snorkel 10. Preferably, longitudinal passageway 62 is aligned with a center axis 62*a* that intersects the center points of the circular upper edge 18 and the circular lower edge 20 of the first shell 16.

Refractory concrete layer 59 extends longitudinally past the upper edge 18 of first shell 16 and covers upper edge 18 and fillet weld 17 and contacts the inner surface 12*b* of flange 12. Refractory concrete layer 59 thus cooperates with refractory lining 58 and the top surface of flange 12 to provide a smooth planar surface for contacting and sealing the snorkel against the reactor vessel.

A second refractory lining 64 is secured to the outer surface 34 of the second shell 26. Lining 64 extends in a radial direction away from the outer surface 34 of the second shell 26 by a sufficient dimension so that lining 64 is sufficient to protect the outer shell 26 from overheating at times when the snorkel 10 is immersed in molten metal. Lining 64 extends from a longitudinal position that is substantially the same as the position of the lower surface 12*c* of flange 12 to a position longitudinally beyond the lower edge 30 of the second shell 26. Additionally, at longitudinal positions beyond the longitudinal position of the retainer 59*a* and refractory lining 58, lining 64 extends radially inwardly from outer shell 26 to contact retainer 59*a* and the longitudinal end position of refractory lining 58. This refractory structure protects the distal ends of first shell 16 and second shell 26 from overheating at times when the snorkel 10 is immersed in molten metal.

In accordance with the presently disclosed embodiment, two arrays of baffles 66 are located in the annular gap 40 between outer surface 24 of first shell 16 and the inner surface 32 of the second shell 26. In the presently preferred embodiment, one array of baffles 66 is located in each opposite half of annular gap 40 that are defined by longitudinal members such as walls 67 and 67*a* that extend longitudinally through annular gap 40 and divide annular gap 40 into two separate chambers 67*b* and 67*c*. Each chamber 67*b* and 67*c* includes at least one primary baffle 68 and an array of baffles 66. Primary baffles 68 are located at different angular positions within annular gap 40 which angular positions are approximately 180° apart. Also, longitudinal members such as primary baffles 68 are longitudinally oriented in the direction of the longitudinal center axis 62*a* of passageway 62.

Primary baffles 68 cooperate with wall 67 or 67*a*, the outer surface 24 of the first shell 16, and the inner surface 32 of the second shell 26 to define a passageway 70 for conveying air or other cooling medium longitudinally through annular gap 40 from the upper region 42 of annular gap 40 to the lower region 44 of annular gap 40. Passageway 70 is generally aligned with the direction of passageway 62 between upper edge 18 and lower edge 20 of first shell 16.

The array of baffles 66 further includes at least two arcuate baffles 72 that are located in annular gap 40 at respective longitudinal positions along snorkel 10. Each arcuate baffle 72 has opposite ends 74 and 76 that are located in annular gap 40 at different angular positions about axis 62*a* so that arcuate baffles 72 define an arc between the ends 74 and 76. Arcuate baffles 72 in the array of baffles 66 are respectively located at different longitudinal positions of said annular gap. At least three longitudinally adjacent arcuate baffles cooperate with the outer surface 24 of the first shell 16 and the inner surface 32 of the second shell 26 to define at least two arcuate passageways 78 that are longitudinally adjacent to each other for conveying air or another cooling medium though annular gap 40 in an angular direction with respect to the longitudinal axis 62*a* of passageway 62.

Collectively, passageways 78 also convey the cooling medium in a longitudinal direction from the lower edge 20 of first shell 16 toward the upper edge 18 of first shell 16. One of ends 74, 76 of each arcuate baffle 72 is connected to one of the primary baffles 68 or to one of walls 67, 67*a*. The other of end 74, 76 of arcuate baffles 72 is a free end that is spaced apart from a primary baffle 68 and walls 67, 67*a*. Thus, a separate circuit or flow path is defined for each chamber 67*b*, 67*c*.

In the longitudinal direction through annular gap 40, each flow path passes through an opening between passageways that are located longitudinally adjacent to each other. The opening is defined by one of free ends 76 of arcuate baffle 72, one of the primary baffles 68 or walls 67, 67*a*, the outer surface 24 of the first shell 16, and the inner surface 32 of the second shell 26. At least one of the longitudinally oriented members 68, 67 or 67*a* are connected to the ends 74 of baffles 72 that are located longitudinally adjacent to and on opposite sides of a baffle 72 with a free end 76 that is spaced apart from the same longitudinal member 68, 67 or 67*a*. In this way, the longitudinal member 68, 67 or 67*a* cooperates with free end 76 of baffle 72 and with the outer surface 24 of first shell 16 and the inner surface 32 of the second shell 26 to define a vertical opening between two longitudinally adjacent passageways 78 to create a serpentine flow path through the passageways. The flow path through passageways 78 is thus in series because the flow is first through one passageway 78, then through the opening at one end of the passageway, and then through the second longitudinally adjacent passageway 78.

Stated differently, alternate baffles 72 in baffle array 66 have an end 74 that is connected to a longitudinally oriented member 68, 67 or 67*a*. The same longitudinal member 68, 67 or 67*a* also cooperates with the free end 76 of the other baffles in the baffle array 66, outer surface 24 of first shell 16, and inner surface 32 of second shell 26 to define openings between longitudinally adjacent passageways 78 to define a serpentine flow path between a passageway 78 at one longitudinal position of annular gap 40 and another passageway 78 at a second longitudinal position of annular gap 40.

The flow path thus established communicates through openings between vertically adjacent arcuate passageways 78. One end 74 of each of vertically adjacent arcuate baffles 72 is connected to a different longitudinally oriented member such as primary baffle 68 or wall 67, 67*a* so that the flow path through annular gap 40 follows a serpentine pathway from the lower region 44 of the annular gap 40 to the upper region 42 of the annular gap 40 as illustrated in FIGS. 1-3.

The serpentine pathway herein disclosed maximizes the cross-sectional area of the flow path through annular gap 40 for the cooling medium. It has been found that the presently disclosed apparatus affords approximately 20 times greater cross-sectional area flow for the cooling medium than cooling pipes known in the prior art. This has resulted in a rate of heat transfer away from first shell 16 and second shell 26 that is substantially 10 times the rate of heat transfer of cooling apparatus known in the prior art.

As also shown in FIGS. 1-3, a fluid inlet 80 is in fluid communication with each passageway 70 in annular gap 40. When cooling medium is received at fluid inlet 80, it flows to the upper region 42 of annular gap 40. From upper region 42 the cooling medium flows through passageway 70 to the lower region 44 of annular gap 40, and then through the serpentine pathway of passageways 78 as previously explained. In each chamber 67*b*, 67*c*, a fluid outlet 82 is in fluid communication with one of the passageways 78 in annular gap 40 that convey cooling medium angularly with respect to the longitudinal axis of passageway 62 such that cooling medium is exhausted through fluid outlet 82. In this way, inlet 80 is in fluid communication with outlet 82 through at least two passageways 78 that are arranged for fluid flow through the passageways in series-one after the other.

Cooling media flows simultaneously to fluid inlets 80 for each of the chambers of annular gap 40 such that cooling medium flows concurrently through the first and second chambers of the annular gap. This parallel flow of cooling medium through separate chambers or circuits of annular gap 40 increases the flow rate of the cooling medium to increase the rate of heat transfer away from the steel shells 16, 26 in comparison to apparatus in which the internal passageway includes only a single fluid inlet and a single fluid outlet. In alternative embodiments more than two parallel circuits could be used as will be apparent to those skilled in the art.

When the snorkel serves as the up snorkel, it further includes a plurality of pipes 92. Pipes 92 are secured in the layer of refractory concrete 59*a*. Each of pipes 92 has a respective inlet 94 for receiving an inert gas that can be injected into molten metal flowing in passageway 62. The inert gas supports the upward movement of steel from the ladle to the degasser vessel, and creates a turbulent condition inside the vessel that significantly increases the rate of carbon reduction during the RH process. Each of said pipes 92 further includes an outlet 96 for discharging the inert gas from the pipe 92 in a direction that is generally radially inward with respect to passageway 62. The inert gas passes into molten metal in the snorkel passageway from the inner surface 60 of the refractory lining 58.

From the forgoing description, other embodiments of the invention that is herein disclosed also will become apparent to those skilled in the art. Such embodiments are also included within the scope of the following claims.

I claim:

1. A snorkel for use with a reaction vessel for degassing molten metal, said snorkel comprising:

a first shell having an upper edge and a lower edge, said first shell defining a closed an outer surface and a closed inner surface between said upper and lower edges;

a second shell having an upper edge and a lower edge, said second shell defining a closed outer surface and a closed inner surface between said upper and lower edges, said second shell being oriented outside said first shell with the outer surface of said first shell opposing the inner surface of said second shell to define an annular gap therebetween, said second shell having an inlet opening and an outlet opening that are in fluid communication with said annual gap;

a first refractory lining that is secured to the inner surface of said first shell;

a second refractory lining that is secured to the outer surface of said second shell; and an array of baffles, each baffle in said array of baffles being located in said annular gap between the outer surface of said first shell and the inner surface of said second shell, each baffle being located at a different respective longitudinal position of said annular gap, at least three longitudinally adjacent baffles in said array cooperating with the outer surface of said first shell and the inner surface of said second shell to define a first passageway and a second passageway with the first passageway being longitudinally adjacent to the second passageway, said inlet opening being in fluid communication with said outlet opening through said first passageway in series with said second passageway.

2. The snorkel of claim 1 wherein at least one baffle of said baffle array has one end that is a free end, the free end of said baffle cooperating with the outer surface of said inner shell and with the inner surface of said outer shell to partially define an opening between said first passageway and said second passageway.

3. The snorkel of claim 2 wherein the baffle in the middle longitudinal position of said at least three longitudinally adjacent baffles has one end that is a free end, the free end of said baffle cooperating with the outer surface of said inner shell and with the inner surface of said outer shell to partially define an opening between said first passageway and said second passageway.

4. The snorkel of claim 3 wherein said first shell is cylindrical and said second shell is also cylindrical.

5. The snorkel of claim 4 wherein said passageways are arcuate-shaped passageways.

6. The snorkel of claim 5 further comprising a flange that is connected to said first shell.

7. A snorkel for use with a reaction vessel for degassing molten metal, said snorkel comprising:

a first shell having an upper edge and a lower edge, said first shell defining a closed outer surface and a closed inner surface between said upper and lower edges;

a second shell having an upper edge and a lower edge, said second shell defining a closed outer surface and a closed inner surface between said upper and lower edges, said second shell being oriented outside said first shell with the outer surface of said first shell opposing the inner surface of said second shell to define an annular gap therebetween, said second shell having an inlet opening and an outlet opening that are in fluid communication with said annual gap;

a first refractory lining that is secured to the interior surface of said first shell;

a second refractory lining that is secured to the outer surface of said second shell;

an array of baffles, each baffle in said array of baffles being located in said annular gap between the outer surface of said first shell and the inner surface of said second shell and being located at a different respective longitudinal position of said annular gap, longitudinally adjacent baffles in said array cooperating with the outer surface of said first shell and the inner surface of said second shell to define at least first and second passageways, said inlet opening being in fluid communication with said outlet opening through said first passageway in series with said second passageway, at least one of said baffles having a free end; and at least one member that is longitudinally oriented in said annular gap and that is connected to the ends of at least two baffles that are positioned longitudinally adjacent to said baffle, having a free end such that said longitudinal member cooperates with the free end of said baffle and with the outer surface of said inner shell and the inner surface of said outer shell to define a vertical opening between said first passageway and said second passageway such that there is a serpentine flow path through said first and second passageways.

8. The snorkel of claim 7 wherein said first shell is cylindrical and said second shell is also cylindrical.

9. The snorkel of claim 8 wherein said passageways are arcuate-shaped passageways.

10. The snorkel of claim 9 wherein each of said baffles have a second end that is oppositely disposed from said free end of said baffle and wherein a longitudinally oriented member is connected to the second end of alternate members of said baffle array, said longitudinally oriented member also cooperating with the free end of the other baffles of said baffle array and with the outer surface of said inner baffle and the inner surface of said outer baffle to define vertical openings between longitudinally adjacent arcuate-shaped passageways to define a serpentine flow path between a passageway at one longitudinal position of the annular gap and another passageway at a second longitudinal position of the annular gap.

11. A snorkel for use with a reaction vessel for degassing molten metal by holding a partial vacuum on the molten metal, said snorkel being connectable to said reaction vessel and comprising:

a flange that is connectable to the reaction vessel;

a first shell that has an upper edge and a lower edge, said first shell defining a closed outer surface and a closed inner surface between said upper and lower edges, the upper edge of said first shell defining a first circular edge and the lower edge of said first shell defining a second circular edge;

a second shell with an upper edge and a lower edge, said second shell defining a closed outer surface and a closed inner surface between said upper and lower edges, the upper edge of said second shell defining a first circular edge and the lower edge of said second shell defining a second circular edge, said second shell being oriented concentrically with respect to said first shell with the outer surface of said first shell opposing the inner surface of said second shell and defining an annular gap between the outer surface of said first shell and the inner surface of said second shell;

a refractory lining that is secured to the inner surface of said first shell, said refractory lining having an inner surface that defines a passageway along a longitudinal axis that intersects the centerpoints of the first and second circular edges of said first shell;

a refractory lining that is secured to the external surface of said second shell; and an array of arcuate-shaped baffles that is located in the annular gap between the outer surface of said first shell and the inner surface of said second shell, each of said arcuate-shaped baffles being located at a different longitudinal position of said annular gap, said arcuate-shaped baffles cooperating with the outer surface of said first shell and the inner surface of said second shell to define at least two arcuate passageways for conveying cooling medium through said annular gap, said arcuate-shaped baffles having one end that is a free end and also have a second end that is oppositely disposed from said free end;

at least one primary baffle that cooperates with the free end of at least one of said arcuate-shaped baffles, the inside of the second shell, and the outside of the first shell to define an opening in the longitudinal direction between longitudinally adjacent arcuate passageways, said primary baffle also connected to the second end of at least one of said arcuate-shaped baffles to block the flow of cooling medium longitudinally past said arcuate baffle, said arcuate-shaped baffles being longitudinally adjacent to each other in said array so as to define a serpentine flow path through said passageways.

12. The snorkel of claim 11 wherein said arcuate baffles that are located in the annular gap at different longitudinal positions have ends that are located in the annular gap at different angular positions so that said arcuate baffles define an arc between said ends, said arcuate baffles cooperating with the outer surface of said first shell and the inner surface of said second shell to define at least two arcuate passageways for conveying cooling medium angularly with respect to the longitudinal axis of the passageway between the first and second openings of said first shell, one end of each of said arcuate baffles being connected to a primary baffle and the other end of each of said arcuate baffles being spaced apart from a primary baffle to define a longitudinal flow path between the end of said arcuate baffle, a primary baffle, the outer surface of the first shell and the inner surface of the second shell, each of said arcuate baffles that are longitudinally adjacent to each other being connected to a different primary baffle to create a serpentine flow path through the annular gap.

13. The snorkel of claim 12 comprising:

at least two primary baffles that are located at different angular positions of said annular gap and that are oriented in the direction of the longitudinal axis, said primary baffles cooperating with the outer surface of said first shell and the inner surface of said second shell to define at least one passageway for conveying cooling medium longitudinally through said annular gap.

14. The snorkel of claim 13 comprising:

a fluid inlet that is in communication with the at least one passageway for conveying cooling medium longitudinally through said annular gap; and a fluid outlet that is in communication with one of said arcuate passageways for conveying cooling medium angularly with respect to the longitudinal axis of the passageway between the first and second openings of said first shell.

15. A snorkel for use with a reaction vessel for degassing molten metal by holding a partial vacuum on the molten metal, said snorkel being connectable to said reaction vessel and comprising:

a flange that is connectable to the reaction vessel;

a first shell that has an upper edge and a lower edge, said first shell defining a closed outer surface and a closed inner surface between said upper and lower edges;

a second shell with an upper edge and a lower edge, said second shell defining a closed outer surface and a closed inner surface between said upper and lower edges, said second shell being located concentrically with respect to said first shell with the outer surface of said first shell opposing the inner surface of said second shell and defining an annular gap between the outer surface of said first shell and the inner surface of said second shell, said second shell having a first opening to said annular gap and also having a second opening to said annular gap;

a refractory lining that is secured to the inner surface of said first shell, said refractory lining having an inner surface that defines a passageway along a longitudinal axis that intersects the centerpoints of the upper and lower edges of said first shell;

a refractory lining that is secured to the external surface of said second shell; and an array of baffles that is located in the annular gap between the outer surface of said first shell and the inner surface of said second shell, said array of baffles having:

at least two primary baffles that are located at different angular positions of said annular gap and that are oriented in the direction of the longitudinal axis, said primary baffles cooperating with the outer surface of said first shell and the inner surface of said second shell to define at least one passageway for conveying cooling medium longitudinally through said annular gap, said passageway being generally aligned in the same direction as the passageway defined by the refractory lining that is secured to the inner surface of said first shell; and at least two arcuate baffles that are located in the annular gap at different longitudinal positions of said longitudinal axis, each of said arcuate baffles having opposite ends that are located in the annular gap at different angular positions so that said arcuate baffles define an arc between said ends, said arcuate baffles cooperating with the outer surface of said first shell and the inner surface of said second shell to define at least two arcuate passageways for conveying cooling medium angularly with respect to the longitudinal axis of the passageway between the first and second openings of said second shell, one end of each of said arcuate baffles being connected to a selected primary baffle and the other end of each of said arcuate baffles being spaced apart from a primary baffle to define a longitudinal flow path between the end of said arcuate baffle, a primary baffle, the outer surface of the first shell and the inner surface of the second shell, said longitudinal flow path communicating between longitudinally adjacent arcuate passageways, each of said longitudinally adjacent arcuate baffles being connected to a different longitudinal baffle and forming a flow path with a different longitudinal baffle to create a serpentine flow path through said annular gap.

* * * * *